US005666377A

United States Patent [19]

Havas et al.

[11] Patent Number: 5,666,377

[45] Date of Patent: Sep. 9, 1997

[54] MULTIPLE FURNACE CONTROLLER

[75] Inventors: George Havas, Youngstown; Arthur L. Vaughn, Niles, both of Ohio

[73] Assignee: Ajax Magnethermic Corporation, Warren, Ohio

[21] Appl. No.: 340,627

[22] Filed: Nov. 16, 1994

[51] Int. Cl.[6] ..... H05B 6/06

[52] U.S. Cl. ..... 373/147; 373/149; 219/661; 363/96

[58] Field of Search ..... 373/147, 148, 373/149, 150, 6, 138, 139, 7; 219/619, 663, 662, 661; 363/96, 97, 98, 132; 323/350

[56] References Cited

U.S. PATENT DOCUMENTS

| | | | |
|---|---|---|---|
| 2,451,518 | 10/1948 | Strickland, Jr. . | |
| 4,225,912 | 9/1980 | Messer | 363/57 |
| 4,336,585 | 6/1982 | Moriarty et al. | 363/79 |
| 4,390,769 | 6/1983 | Steigerwald | 219/660 |
| 4,506,131 | 3/1985 | Boehm et al. | 219/660 |
| 4,695,316 | 9/1987 | Cartlidge | 75/10.14 |
| 5,250,777 | 10/1993 | Fishman | 219/619 |
| 5,272,719 | 12/1993 | Cartlidge et al. | 373/138 |

FOREIGN PATENT DOCUMENTS

| | | |
|---|---|---|
| 562 471 | 3/1993 | European Pat. Off. . |
| 641 145 | 11/1993 | European Pat. Off. . |
| 976 100 | 11/1952 | Germany . |
| 1 037 039 | 8/1958 | Germany . |

*Primary Examiner*—Tu B. Hoang

[57] ABSTRACT

A multi-furnace control system selectively delivers preselected percentages of available power to furnaces of the system, preferably designated as either a melt furnace or a hold furnace. The power supply delivers power to both furnaces. A capacitor station in parallel connection to the power supply and the furnaces is tuned to form a tank circuit therewith. Switches control the selected power delivered to the furnaces respectively and control the delivery of a first portion of the power for holding molten product in the hold furnace as the master control. A remaining portion of the power is then delivered for melting product in the melt furnace. The capacitor station acts as a reactive tank for both furnaces.

12 Claims, 8 Drawing Sheets

MULTIPLE FURNACE CONTROLLER

BACKGROUND OF THE INVENTION

The invention relates to a power supply control system for delivering power concurrently to multiple furnaces, and more particularly to a control system for delivering power in a controlled, predetermined apportioned manner to two furnaces simultaneously from a single power supply and a single reactive capacitor station.

Power supplies for selectively or alternatively heating multiple induction furnaces are known. One system for powering two melting furnaces alternately that has been often used in the past is referred to as a "butterfly operation." In such an operation, a single power supply supplies energy alternately to two furnaces operating as a holding furnace and a melting furnace. The first furnace holds molten metal and requires only enough power to control the metal temperature so that it remains molten. The second furnace holds metal to be melted as rapidly as possible. The power supply is normally located in such a position that its output can be readily switched from one furnace to the other. Initially the power supply is connected to the melting furnace and delivers as much power to the load as possible. The temperature of the metal in the holding furnace is monitored. When the molten metal temperature in the holding furnace reaches a minimum, the power to the melting furnace is shut off, the output of the power supply is connected to the holding furnace and the holding furnace is energized. The power is kept on for the holding furnace until the metal temperature reaches a maximum limit. At that time the power to the holding furnace is shut off, the output of the power supply is connected to the melting furnace and the melting furnace is energized. This operation is repeated throughout the melting cycle whenever the temperature control of the holding furnace demands power.

The result of the butterfly operation is poor temperature control in the holding furnace and poor utilization of power to the melting furnace. In addition, the power supply must turn off/on at each switching to allow transfer of output connections, which means that during transfer neither furnace receives power.

In terms of efficiency of use of power, an improved system is shown in U.S. Pat. No. 5,272,719 which discloses a power supply system for simultaneously melting metal and holding molten metal for casting operations with a single power supply. The power supply is connected to the furnaces through a switching network wherein a plural output power supply comprises at least one rectifier section having an output and a plurality of high frequency inverter sections equal to the number of separate induction furnaces.

A particular problem with this system is that each furnace requires its own high-frequency inverter system which necessarily includes expensive tank and filter capacitors and the associated switch circuitry for controlling delivery of power to each of the furnaces. In addition, power consumption to activate respective capacitor tank circuits for each of the furnaces is increased over a system avoiding a need for multiple tank circuits.

The present invention contemplates a new and improved multi-furnace control system which overcomes the above-referred to problems and others to provide a furnace control system for simultaneously powering multiple furnaces such as a holding furnace and a melting furnace from the same capacitor station at preselected individual furnace power levels, during which all operation of the power supply and furnace capacitors is accomplished within safe limits.

BRIEF SUMMARY OF THE INVENTION

In accordance with the present invention there is provided a multiple furnace control system for delivering operator selected power levels for preferably melting or holding the product contained in the furnaces of the system. Usually, first and second furnaces are associated with the power supply for delivering power to the furnaces and a capacitor station in parallel connection to the power supply and the furnaces to form a tank circuit therewith. Switches for selectively controlling the power delivered to the furnaces include means for controlling delivery of a first portion of the power for holding molten product in the first or "hold" furnace as the master control, and controlling delivery of the remaining portion of the power for melting product in the second or "melt" furnace, whereby the capacitor station serves as a reactive tank for both furnaces.

In accordance with another aspect of the present invention, the switch circuit comprises a solid state control switch (SCR) for limiting power to the hold furnace and a plurality of selector switches for controlling which of the furnaces will receive hold power and which will receive melt power. The power supply comprises a conventional inverter circuit, except that it also includes a special feedback loop control responsive to the operator selected power levels. When the first furnace is switched from a hold furnace to a melt furnace, it is switched out of series with the SCR and into a direct parallel connection to the capacitor station. When the second furnace is switched from a melt furnace to a hold furnace, it is switched into series with the SCR so the power level can be adjusted as desired. The system can be configured to always put the SCR in series to the furnace with the lower demand level.

The invention also comprises a method of operating a multi-furnace system including melt and hold furnaces, wherein a power supply and a capacitor station are disposed in parallel connection to the furnaces and a switch circuit controls power delivered to the furnaces respectively. The method includes the steps of setting a first furnace as the hold furnace, including identifying the portion of the power necessary to maintain product contained in the hold furnace in the molten state. A second step is delivering the identified portion of the power from the power supply to the hold furnace with a power control switch disposed in series with the hold furnace. A remaining portion of the power can then be delivered directly to the melt furnace for melting product contained therein. The invention comprises selectively switching the furnaces alternately from either a hold furnace to a melt furnace in accordance with product status needs.

The subject invention provides the benefit of the application of the appropriate power to any furnace in the system continuously to precisely control the temperature of the product therein, while simultaneously supplying as much of the remaining power as is operator selected and available to other furnaces of the system.

Another benefit obtained from the present invention is that the same power supply and capacitor station is employed for powering both furnaces simultaneously.

Other benefits and advantages of the subject new multi furnace control system will become apparent to those skilled in the art upon a reading and understanding of the specification.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof and wherein.

DETAILED DESCRIPTION OF THE INVENTION

Figure 1A:
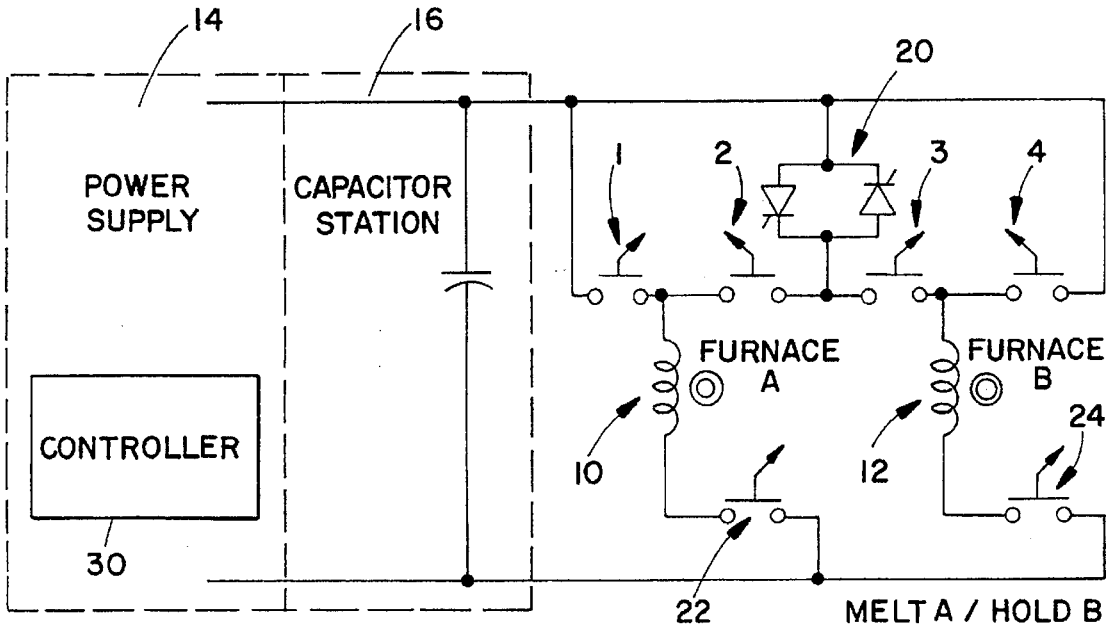
FIG. 1A comprises a schematic block diagram of a multi-furnace system formed in accordance with the present invention.

Referring now to the drawings wherein the showings are for purposes of illustrating the preferred embodiments of the invention only, and not for purposes of limiting same, the FIGURES show a multi-furnace control system comprised of first and second induction furnaces A and B, which induce heat in a product contained therein by induction coils 10, 12 that are powered by a power supply 14 and a reactive capacitor tank station 16. The power supply 14 is a conventional inverter which is well-known for supplying the appropriate alternating current to the coils 10, 12 to power the furnaces A and B. The power supply 14 and the capacitor station 16 are in parallel connection to the furnaces A and B so that the same capacitor station which would conventionally be needed for a single melting surface, suffices as a reactive tank for both the melting and holding operations of both furnaces A and B, concurrently. As will hereinafter be explained in more detail, the operating of the power supply, the capacitor station and the furnaces is accomplished so that the power is delivered while operating the supply and the capacitors within safe limits.

Figure 1B:
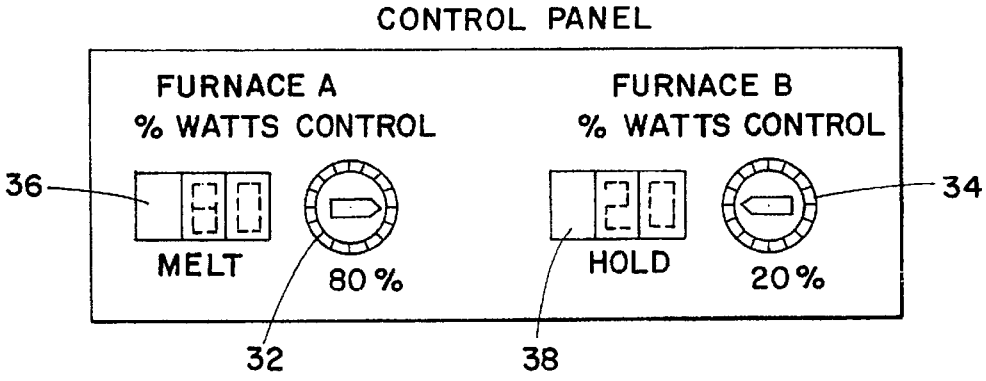
FIG. 1B shows a control panel as could be exposed to an operator in accordance with the embodiment of FIG. 1A.
Figure 2A:
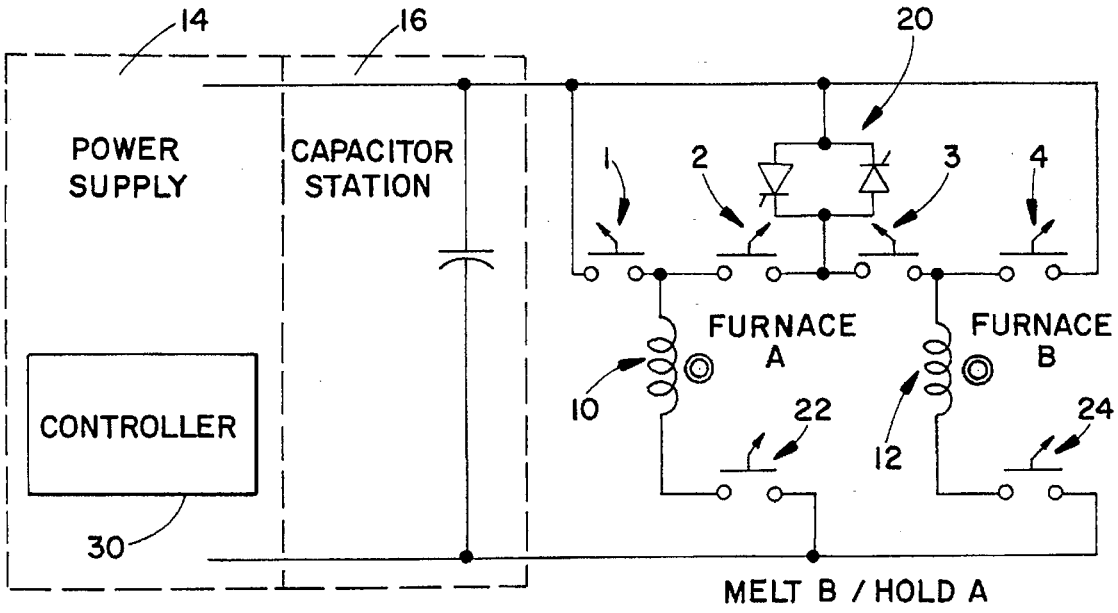
FIG. 2A comprises a schematic block diagram of the multi-furnace system of FIG. 1A in an alternative circuit configuration.

In the embodiments of FIGS. 1A and 2A, a switch means for controlling the power delivered to the furnaces A and B comprises a plurality of selector switches 1, 2, 3, 4 and a solid state control switch (SCR) 20. A controller 30 controls the switch operation based on operator input from the control panel, FIG. 1B. Safety disconnect switches 22, 24 are provided to manually disconnect the furnaces from the power supply. The selector switches 1–4 are operated so that one of the furnaces is directly connected across the capacitor station while the other is connected across the capacitor station with the SCR 20 in series therewith. Microswitches (not shown) are also provided on all of the selector switches to report their state to the controller 30. When the safety disconnect switches 22, 24 are open, the control system will also open the appropriate selector switches 1–4 to fully isolate the furnace.

With particular reference to FIG. 1B, a control panel as would be operated and viewed by an operator of the system of FIG. 1A is shown. A selector switch, such as potentiometers 32, 34 allow an operator to select a portion of the percentage of available power that can be delivered by the power supply and capacitor station to each of the furnaces. As seen therein, furnace A has been set to receive eighty percent (80%) of the available power and furnace B has been set to receive twenty percent (20%) of the available power. A digital readout 36, 38 apprises the operator of the actual percentage of power being delivered to the furnaces.

It is a feature of the invention that whichever one of the furnaces A, B is selected by the operator to receive the lower amount of available furnace power is connected in series with the thyristor 20 and the furnace which is selected to receive the higher percentage of available power is connected directly across the power supply and capacitor station 14, 16. Conventionally, the furnace selected to have the lower power requirement will usually be the hold furnace, while the other furnace will usually comprise the melt furnace; however, in actuality, which furnace is the melt furnace and which is the hold furnace is irrelevant, since the control scheme is based upon selected power to be delivered rather than the actual purpose for the power, i.e., holding or melting.

It is another important feature of the invention that the scheme employs the lower power requirement as the master control, which is always satisfied for its selected power requirement, while the other furnace, selected to receive the higher percentage of available power, is limited to receiving whatever available power remains.

More particularly, and with continued reference to FIGS. 1A and 1B, furnace B has been selected to receive twenty percent (20%) of the rated power from the power supply and capacitor station 14, 16. Furnace A has been selected to receive eighty percent (80%) of the available rated power. In a conventional setting, furnace B would then be the hold furnace and furnace A would be the melt furnace, but as noted above, the actual function of the furnace is irrelevant. However, since furnace B has been selected to receive the lower percentage of power, thyristor 20 is switched by the selector switches 1–4 to be in series with furnace B by the closing of switch 3 and the opening of switch 4. Furnace A is directly across the capacitor station by the closing of switch 1 and the opening of switch 2. In this case, one-hundred percent (100%) of the available power from the power supply is communicated to both furnaces for highly efficient melt and hold operation. All switching is effected by the controller 30 in response to the operator selected settings of potentiometers 32, 34 or individual furnace on/off push buttons not shown in FIGS. 1B or 2B, but accounted for in FIGS. 5A and 5B. In actuality, the controller will operate the converter 14 so that it will seek to supply eighty percent (80%) of the rated power to furnace A so long as it can satisfy the twenty percent (20%) requirement selected for furnace B. This is accomplished by the thyristor operating to reduce the available power from the power supply and capacitor station 16 to the twenty percent (20%) selected level.

Figure 2B:
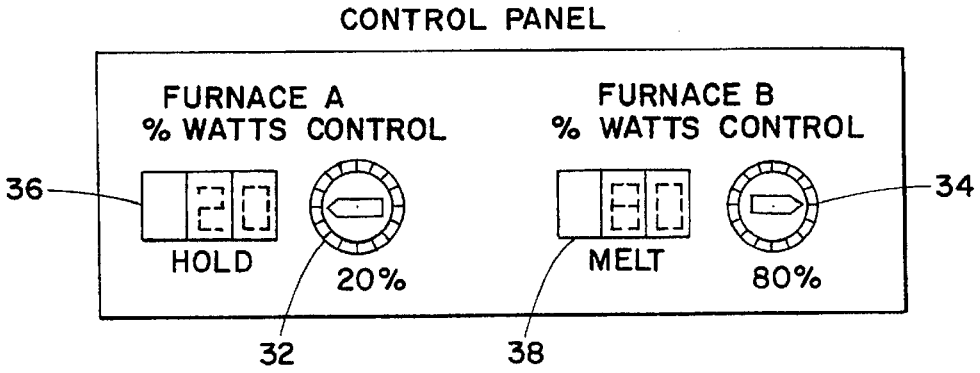
FIG. 2B shows the control panel for the embodiment of FIG. 2A.

FIGS. 2A and 2B show the situation where the operator has reversed the conditions so that now furnace A is to receive twenty percent (20%) of the rated power and furnace B is to receive eighty percent (80%). In which case, the selector switches are reversed so that switches 1 and 3 are open and switches 2 and 4 are closed after a short no-load switching operation.

In a situation where the operator has selected two different power levels whose percentages sum higher than the one-hundred percent (100%) of power that can be supplied by the power supply, the system will first satisfy the lower power requirement, since it is the master control and then supply the remaining portion that is available to the other furnace. For example, if an operator were to select the hold furnace to receive thirty percent (30%) of the available power from the power supply and selected the melt furnace to receive eighty percent (80%) of the available power, the sum would be one-hundred ten percent (110%), which is ten percent (10%) higher than the supply can deliver assuming that it is built to only give its rated power. In this situation, even though the operator had requested eighty percent (80%) of the rated power to be supplied to the melt furnace, the melt furnace would only receive seventy percent (70%) of the available power. The control panel would indicate that the hold furnace was selected to receive thirty percent (30%) and the display would indicate that it was receiving this percentage of available power, while the melt furnace, though selected to receive eighty percent (80%) at the potentiometer, would have a display that would only indicate seventy percent (70%) of available power being delivered to the furnace.

Several advantages flow from this control scheme. First, the power supply and capacitor station 14, 16 will tend to be operated at maximum efficiency so that a single power supply and capacitor station 14, 16 can power a plurality of furnaces. Second, since the control scheme sets the lower selected power level as the master control, it will always receive its selected power while the other furnace can receive either a portion of or all of the available remaining power. Third, thyristor pair 20 can control the power to either of the furnaces by being connected in series to one of them by the selector switches 1–4. Accordingly, a plurality of furnaces are powered by a single thyristor, a single capacitor station and a single power supply.

Figure 3:
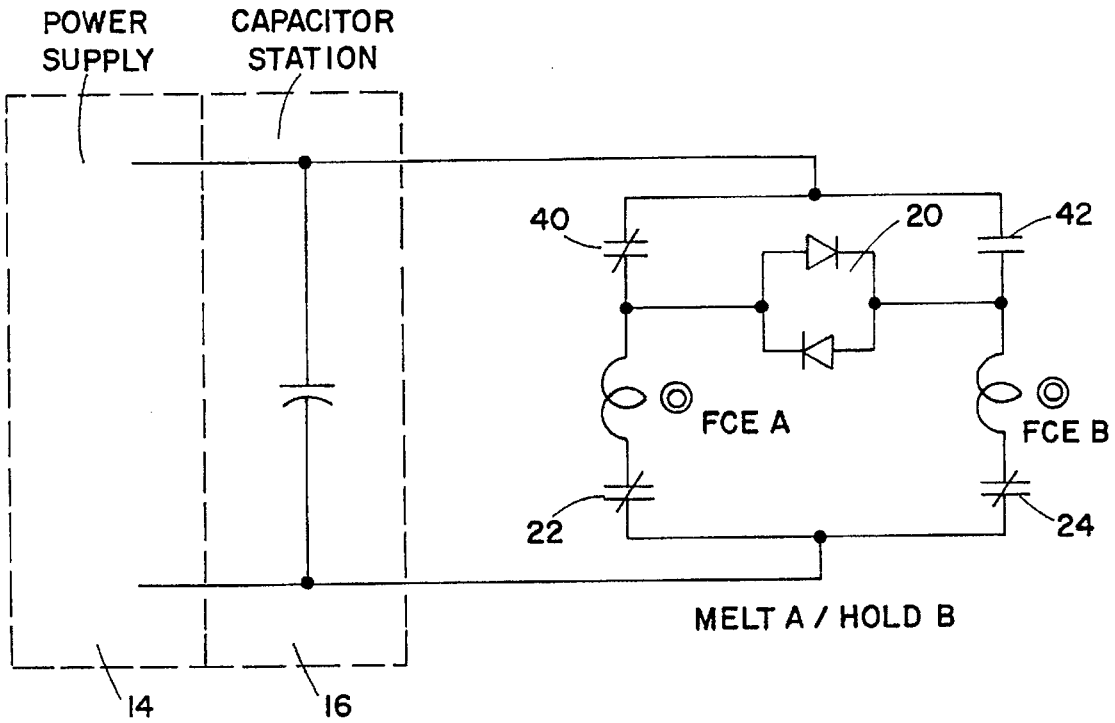
FIG. 3 shows an alternative circuit configuration to that of FIGS. 1A and 2A.

With reference to FIG. 3, an alternative embodiment of the system is shown wherein only two selector switches 40, 42 are employed to selectively connect the thyristor pair 20 with the furnace A or the furnace B. In the embodiment shown in FIG. 3, furnace A is designated as the melt furnace, since it is directly across the capacitor station 16, with the closing of switch 40, while furnace B is the hold furnace since it is in series with the thyristor pair 20 due to the opening of switch 42.

Figure 4:
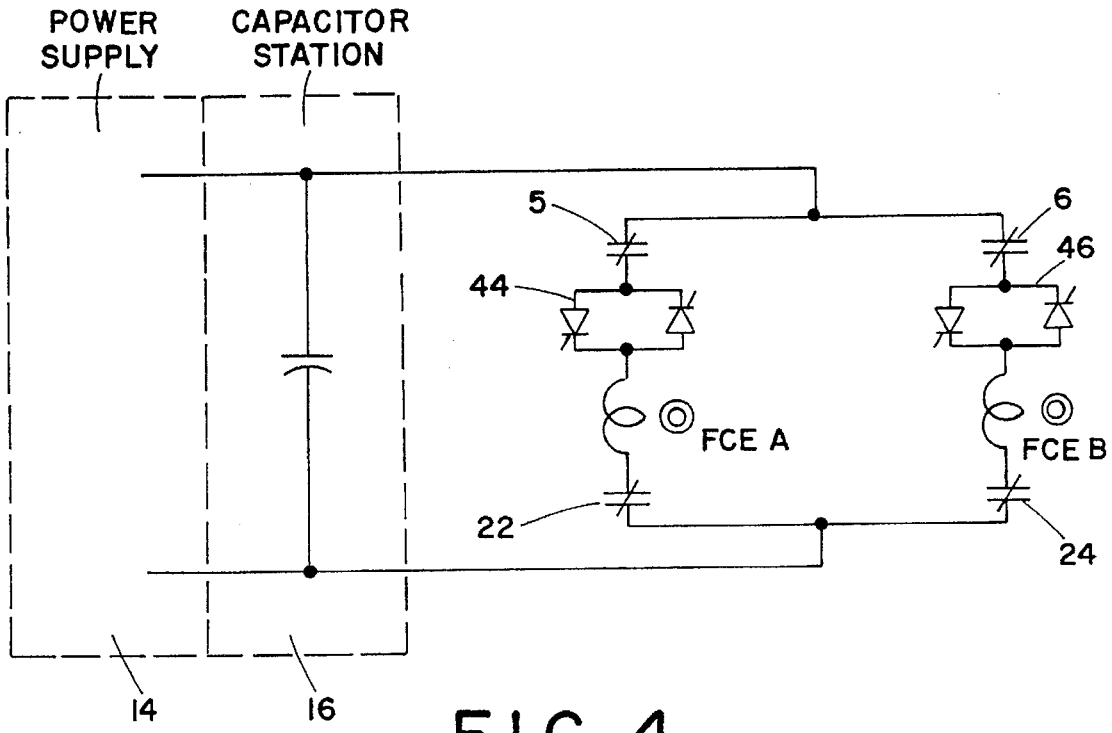
FIG. 4 shows yet another alternative embodiment distinctive in that each of the furnaces in the system include a solid state switch in series therewith.

FIG. 4 comprises yet another alternative embodiment in which two thyristors 44, 46 are employed in series with each of the furnaces. In this case, the thyristors 44, 46 will control the power to the associated furnace as selected by the operator and only two additional isolation switches 5 6 are needed.

With particular references 5A, 5B and 6, the control scheme for coordinating the functions of the control system is illustrated. The basic coordinating function of the control system is to assure that, no matter what the demand of the operator controls are, the power supply is always running or starting into the parallel tuned capacitor station 16. For example, if both furnace A and furnace B are running, and the A furnace is holding (i.e., power controlled through the SCR switch 20) and the operator turns off furnace B, the control system must first turn off the SCR switch 20, then turn off the power supply 14, then swap the switches 1–4 to connect the furnace A directly to the tank 16, then turn on the power supply 14, then bring up the power supply power level to the same level that the furnace A had been running prior to the turning off of the furnace B.

Figure 5A:
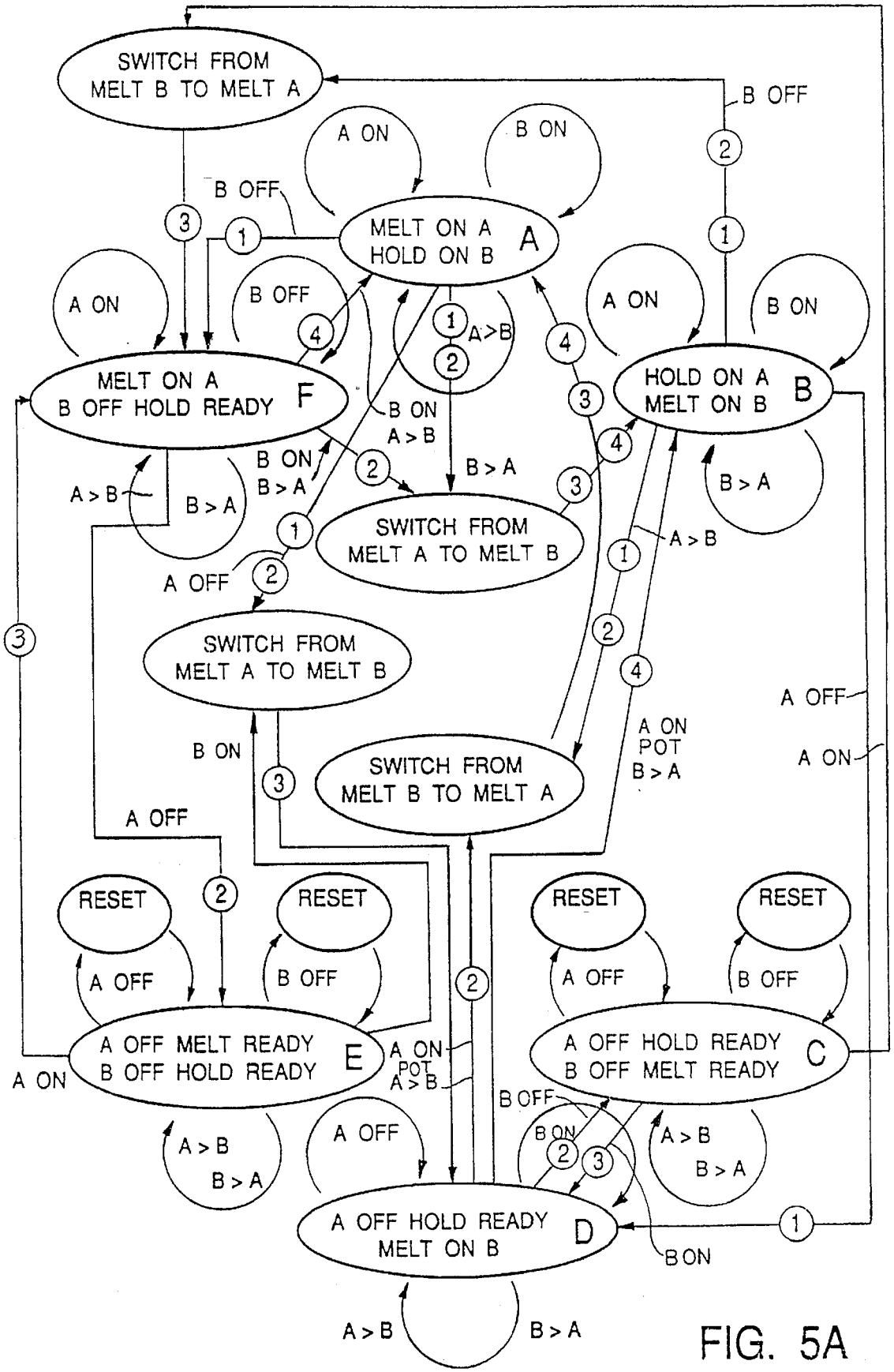
FIG. 5A shows state diagrams illustrating the alternative states of the system and changes in the elements and circuits thereof at different state conditions.
Figure 5B:
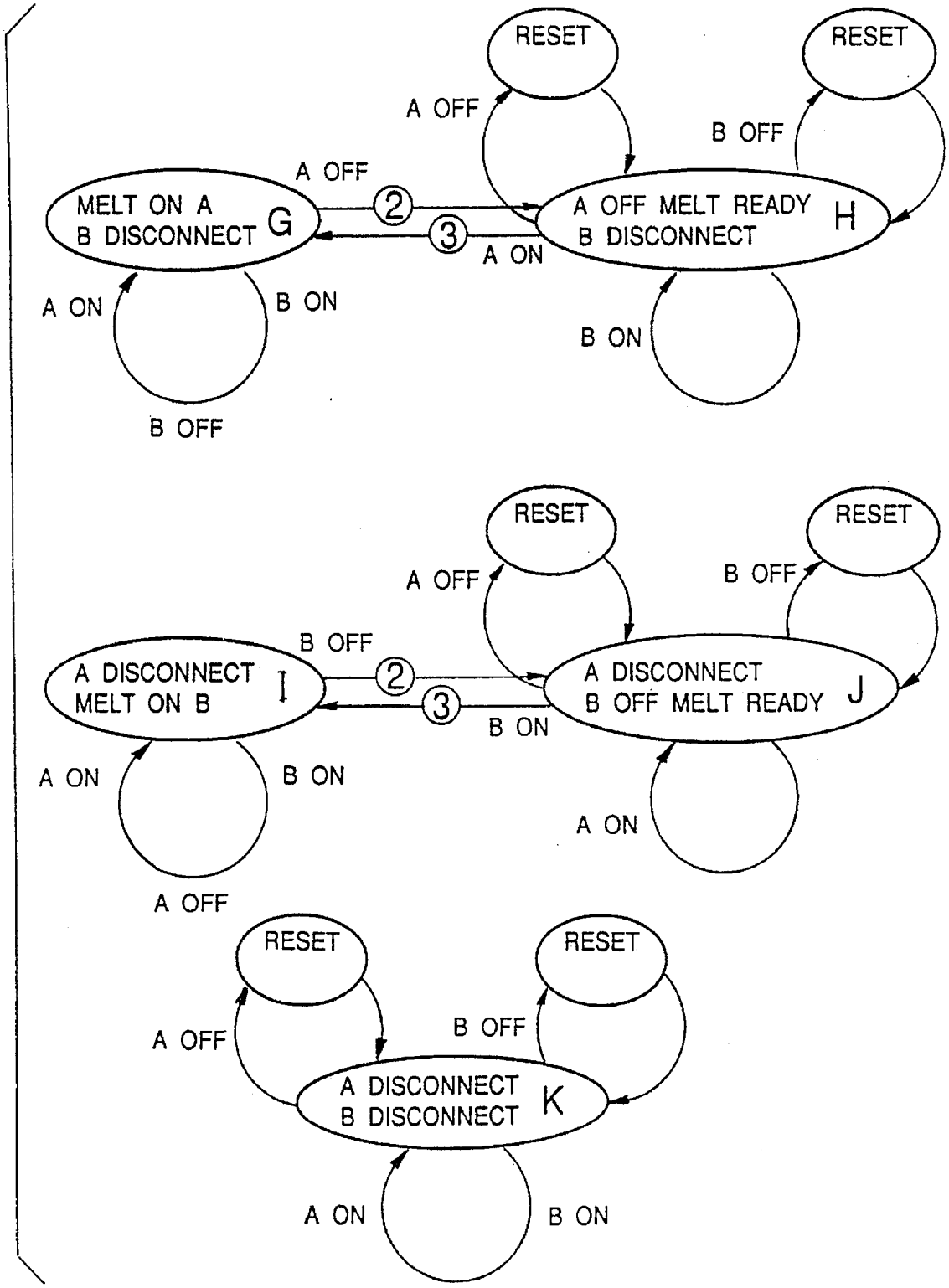
FIGS. 5B and 6 show disconnect detail state diagrams for the selective switches of FIGS. 1A and 2A.
Figure 6A:
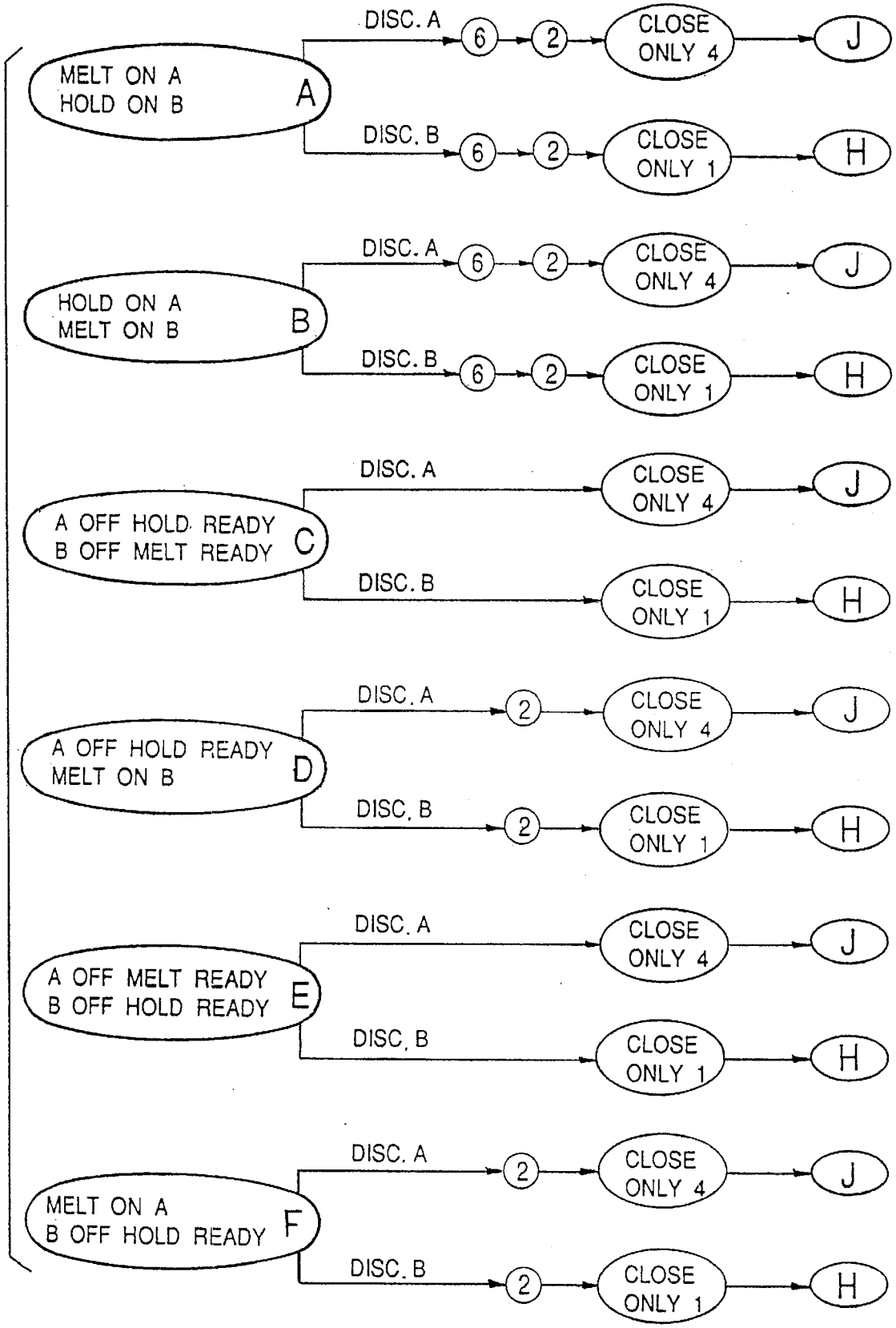
Figure 6B:
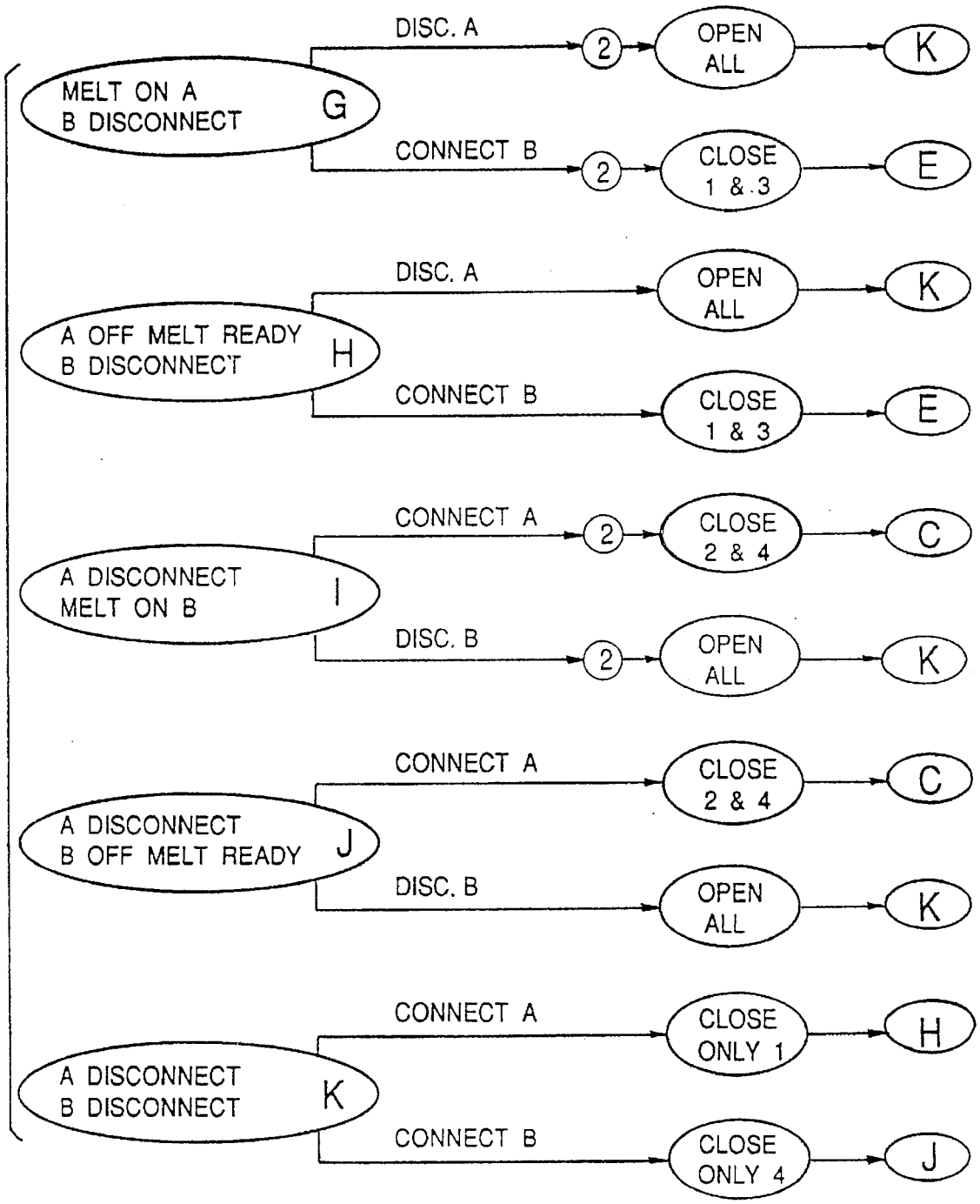

All such states of the furnace switching system are shown in the state diagrams of FIGS. 5A and 5B. Eleven value states are shown therein for the system shown as ovals labeled as states A through K. The lines leading out of the oval states represent operator actions and the circles on the lines are system actions to get from one state to the next. Using state A as an example, possible operator actions and consequences can be explained. State A can be identified as the state where furnace A is melting and furnace B is holding (i.e., switches 1 and 3 are closed while switches 2 and 4 are open, and both manual disconnects 22, 24 are closed). Possible actions are:

1.) The operator pushes the A furnace-on button or the B furnace-on button as shown by the top two circular arcs. The system never leaves state A because both furnaces are already on.

2.) The operator pushes the B furnace-off button as shown by the left line. The system simply turns off the SCR switch (①) and enters state F, where furnace A is still melting and furnace B is off, but all selector switches remain in their current position and furnace B is ready to run again as the hold furnace.

3.) The operator pushes the A furnace-off button as shown by the lower left diagonal line. First the system turns off the SCR switch (①), then it shuts off the power supply (②), then it swaps the position of the selector switches to switch from melting on furnace A to melting on furnace B, because furnace B is about to become the only furnace running and the power supply needs the tank circuit. (The control system opens selector switches 1 and 3 and closes selector switches 2 and 4.) Next the system enters state D after turning on the power supply (③).

4.) The operator turns up the furnace A control potentiometer even higher than the furnace B control potentiometer as shown by the bottom circular arc. The system never leaves the state A because furnace A is already the melter.

5.) The operator turns up the furnace B control potentiometer higher than the furnace A control potentiometer as shown by the bottom vertical line. The system first turns off the SCR switch (①), then turns off the power supply (②), then the selector switches are swapped to cause furnace B to be the melter and furnace A to be the holder and then, after turning on the power supply and the SCR switch (③ and (④), the system enters state B, where furnace B is the melter and furnace A is holding.

6.) The operator opens a furnace manual disconnect switch as shown by one of the two right hand lines out of state A at the top of FIG. 3. The system immediately stops firing the SCR switch and turns off the power supply and enters either state J or state H after opening up the appropriate switch to fully isolate the furnace attached to the opened disconnect switch.

The action described as turning one control potentiometer up higher than the other control potentiometer represents one control scheme for determining which furnace is the melter and which furnace is the hold furnace.

Figure 7:
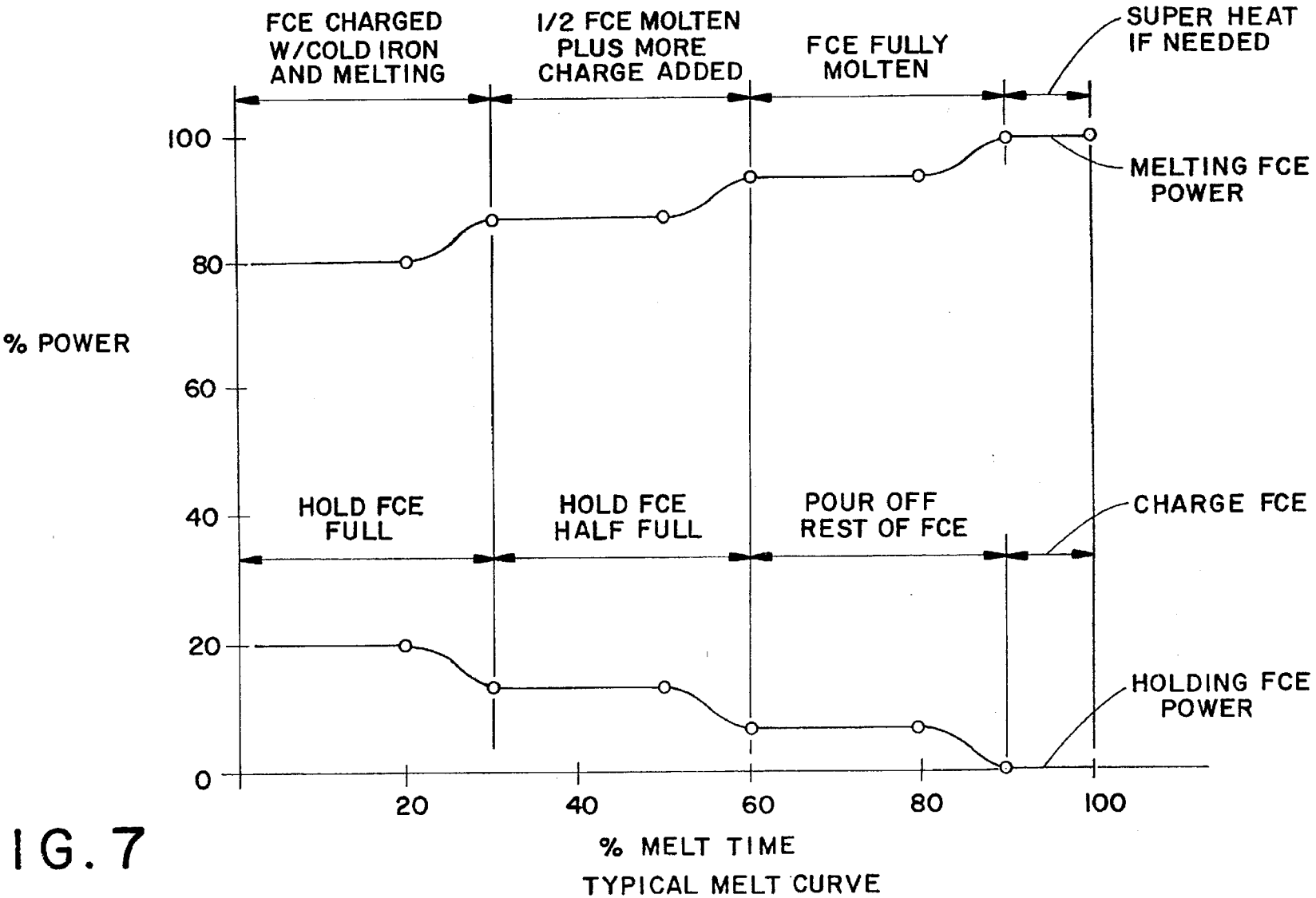
FIG. 7 shows a typical melt cycle for the system of FIGS. 1A and 2A, showing the percentage of power delivered to the respective furnaces simultaneously.

With particular reference to FIG. 7, the advantageous power usage of the system is illustrated. It can be seen therein, that as holding furnace power demands are reduced to zero percent (0%) of the power as the molten product in the furnace is poured off, the power available to the melting furnace correspondingly is increased.

As noted above, the subject invention multi-furnace controller allows the application of the appropriate power to the hold furnace continuously to precisely control the temperature of the molten metal, while simultaneously supplying the melting furnace with up to the maximum remaining available power also continuously. The holding furnace is the master of the scheme. Its power demand is always satisfied first. The melting furnace receives, on demand, up to a maximum of the available power which is determined by the power supply rating and the power demand of the holding furnace. That is, maximum power to the melting furnace equals nominal power rating of the power supply minus the power delivered to the holding furnace.

The invention has been described with reference to the preferred embodiments. Obviously, other circuit arrangements could be employed to accomplish the intended purpose of the subject invention, i.e., a single power supply and a single capacitor station to alternatively power hold and melt furnaces. Alternatively, it is within the scope of the invention to employ other switch means than the control switch 20, such as by putting the furnace load in series with varying impedance, similar results can be obtained.

It is our intention to include all such modifications and alterations in so far as they come within the scope of the appended claims or the equivalents thereof.

Having thus described our invention, we now claim:

1. A furnace control system for delivering power for selectively melting or holding product contained in a plurality of furnaces of the system, comprising:

first and second furnaces;

a power supply for delivering power to the furnaces;

a capacitor station in parallel connection to the power supply and the furnaces and tuned to form a tank circuit therewith; and switch means in operative association with the power supply and the capacitor station for selectively controlling the power delivered to the furnaces respectively, including means for controlling delivery of a first preselected portion of the power for holding molten product in the first furnace as a master control, and for controlling delivery of a remaining portion of the power for melting product in the second furnace, whereby the capacitor station serves as a reactive tank for both furnaces.

2. The furnace control system as defined in claim 1 wherein the first and second furnaces comprise a hold furnace for holding molten product and a melt furnace for melting the product to a molten state.

3. The furnace control system as defined in claim 2 wherein the switch means comprises a power level control switch and a plurality of selector switches disposed to selectively connect the first and second furnaces as either the melt furnace or the hold furnace, respectively.

4. The furnace control system as defined in claim 3, wherein the power level control switch is switched into series with the first furnace when selected as the hold furnace by a first portion of the plurality of selector switches to supply the first preselected portion of the power to the first furnace, and the remaining portion of the power is switched to the second furnace when selected as the melt furnace through a second portion of the plurality of selector switches.

5. The furnace control system as defined in claim 1 further including first and second control potentiometers operatively associated with the first and second furnaces for selecting first and second percentages of available power from the power supply to be respectively delivered to the furnaces and including means for setting a lower one of the first and second percentages as the master control for holding molten product.

6. A method of operating a multiple furnace system whereby selective percentages of available power can be delivered to the furnaces of the system from a common power supply and a common capacitor station in parallel connection to the power supply and the furnaces, wherein the system includes first and second furnaces being selectively or simultaneously operated as a hold furnace or a melt furnace, and switch means for controlling the delivery of the available power to the furnaces respectively from the power supply and the capacitor station, the method comprising the steps of:

setting the first furnace as the hold furnace including identifying a portion of the power necessary to maintain product contained in the first furnace in a holding state;

delivering the identified portion to the first furnace; and, delivering a remaining portion of the power to the second furnace for melting product contained therein.

7. The method of operating a multiple furnace system as claimed in claim 6 wherein the delivering the identified portion and the delivering the remaining portion comprises simultaneous delivery from the power supply and capacitor station to both furnaces.

8. The method of operating a multiple furnace system as defined in claim 6 wherein the delivering the identified portion comprises limiting the power to the first furnace from the power supply and the capacitor station with a phase control switch.

9. A multiple furnace control system for sharing power between furnaces in accordance with preselected percentages made by an operator of available power to be delivered to the furnaces, comprising:

a plurality of furnaces;

a single power supply and a capacitor station, in parallel connection with the power supply and the furnaces, and tuned to form a tank circuit therewith;

means for selecting a first desired percentage of the available power to be delivered to a one of the furnaces; and, switch means in operative association with the power supply and the capacitor station for delivering the desired percentage to the one furnace as a master control of the available power and for delivering a remaining portion of the available power to remaining ones of the furnaces.

10. The multiple furnace control system as defined in claim 9 further including a means for selecting a second percentage of available power to be delivered to a second one of the furnaces, wherein the switch means includes means for determining a lower one of the first and second percentages and for setting the lower one as the master control.

11. The multiple furnace control system as defined in claim 10 wherein the means for selecting the first and second percentages each include means for displaying a percentage of available power delivered to the furnaces, respectively.

12. The multiple furnace control system as defined in claim 10 wherein the means for selecting the first and second percentages each comprises a control potentiometer, and the switch means includes a power level control switch selectively connectable in series with a furnace determined to have the lower one of the selected percentages for setting the power delivered to the furnace determined to have the lower one as the master control.

* * * * *